US007036701B2

(12) United States Patent
Garcia

(10) Patent No.: US 7,036,701 B2
(45) Date of Patent: May 2, 2006

(54) TRASH DISPOSAL METHOD

(75) Inventor: Guadalupe C. Garcia, Modesto, CA (US)

(73) Assignee: Worldwide Safety, LLC, Sacramento, CA (US)

( * ) Notice: Subject to any disclaimer, the term of this patent is extended or adjusted under 35 U.S.C. 154(b) by 0 days.

(21) Appl. No.: 10/449,737

(22) Filed: May 30, 2003

(65) Prior Publication Data

US 2003/0234197 A1 Dec. 25, 2003

Related U.S. Application Data

(60) Provisional application No. 60/384,441, filed on May 31, 2002.

(51) Int. Cl.

| | |
|---|---|
| ***A24F 15/08*** | (2006.01) |
| ***B26F 3/02*** | (2006.01) |
| ***B65D 85/10*** | (2006.01) |
| ***B65D 85/67*** | (2006.01) |

(52) U.S. Cl. ..... 225/1; 225/27; 225/42; 225/49; 225/77; 131/231; 206/246; 221/45; 221/48; 242/588.3

(58) Field of Classification Search ..... 225/1, 225/27, 42, 49, 77, 32, 39, 40, 41, 48; 131/231, 131/235.1; 206/246; 221/33, 34, 38, 45, 221/46, 47, 48, 63; 242/521, 526, 588, 588.3, 242/595

See application file for complete search history.

(56) References Cited

U.S. PATENT DOCUMENTS

| | | | | |
|---|---|---|---|---|
| 2,811,247 | A * | 10/1957 | Stevenson | 206/90 |
| 2,999,584 | A * | 9/1961 | Gillespie | 206/246 |
| 3,057,465 | A * | 10/1962 | Quercio, Jr. | 206/246 |
| 3,096,878 | A * | 7/1963 | Whitley et al. | 206/246 |
| 3,349,778 | A * | 10/1967 | Jablonski | 131/241 |
| 3,368,522 | A * | 2/1968 | Cordis | 118/43 |
| 3,561,453 | A * | 2/1971 | Kline | 131/241 |
| 3,851,809 | A | 12/1974 | McKibbin | |
| 3,915,295 | A * | 10/1975 | Morrison | 206/91 |
| 4,094,416 | A | 6/1978 | Smith | |
| 4,252,237 | A * | 2/1981 | Baclit | 206/86 |
| 5,082,159 | A | 1/1992 | Gutierrez | |
| 5,368,155 | A * | 11/1994 | Ewen | 206/86 |
| 5,680,978 | A | 10/1997 | Pinion | |
| 5,848,595 | A * | 12/1998 | Arthur | 131/238 |
| 5,996,588 | A * | 12/1999 | Abrines Amer | 131/231 |
| D419,259 | S * | 1/2000 | Johnson | D27/175 |
| 6,412,630 | B1 * | 7/2002 | Focke et al. | 206/268 |

* cited by examiner

*Primary Examiner*—Clark F. Dexter
(74) *Attorney, Agent, or Firm*—Lumen Intellectual Property Services, Inc.

(57) ABSTRACT

A trash disposal device and method is provided that can be used to dispose litter and cigarette litter in particular. The device includes sheets of material forming a rectangular box casing that has a slot. Heat resistant material sheets are positioned within the casing such that the sheets may be pulled out of the casing through the slot. A sheet can be pulled out from the device and shaped into an ashtray-like shape that can be used to collect for instance cigarette litter. The ashtray-like shape with the litter can be folded up into a small package and then be placed in a storage area that could be part of the device. The trash disposal device could be assembled with foldable material to form the casing with a slot.

9 Claims, 8 Drawing Sheets

TRASH DISPOSAL METHOD

CROSS-REFERENCE TO RELATED APPLICATIONS

This application is cross-referenced to and claims priority from U.S. Provisional Application No. 60/384,441 filed May 31, 2002, which is hereby incorporated by reference.

FIELD OF THE INVENTION

The present invention relates generally to trash disposal devices and methods. More particularly, the present invention relates to devices and methods to dispose cigarette litter.

BACKGROUND

An estimated 4.5 trillion non-biodegradable cigarette butts are littered worldwide every year. That's billions of cigarettes flicked, one at a time, on our sidewalks, beaches, nature trails, gardens, and other public places every single day. In fact, cigarettes are the most littered item in America and the world. Not only does cigarette litter ruin even the most picturesque setting, but the toxic residue in cigarette filters is damaging to the environment, and littered butts cause numerous fires every year, some of them fatal.

One solution to the problem of cigarette litter is to have more public ashtrays available. However, this would shift the burden to the public organizations to place those public ashtrays, which would unnecessarily increase public spending. It would also still require smokers to approach these ashtrays to dispose their cigarette litter. Another solution to the problem of cigarette litter is to provide smokers with free ashtrays that smokers could carry with them. However, this would require diligent behavior of the smoker to always remember to bring along such an ashtray. Accordingly, there is a need to develop devices and methods that address the problem of cigarette litter, or litter in general.

SUMMARY OF THE INVENTION

The present invention provides a new trash disposal device and method that can be used to dispose cigarette litter. However, as a person of average skill in the art would readily appreciate, the present invention could be used to dispose any type of waste material. The advantage of the present invention is that the disposal device can be integrated with a cigarette pack at the inside of the cigarette pack or the disposal device can be attached to a surface of a cigarette pack. Another advantage of the present invention is that the disposal device is small in size yet it provides a large number of trash disposals. Yet another advantage of the present invention is that the disposed material, which is also referred to in this application as packaged material, can be stored in a storage area that is either part of the disposal device or is integrated in a cigarette pack. In either case, the stored material could be put away in a public trashcan or trash container at a later time when such a public trashcan or trash container becomes available.

BRIEF DESCRIPTION OF THE FIGURES

The objectives and advantages of the present invention will be understood by reading the following summary in conjunction with the drawings, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiments of the invention are set forth without any loss of generality to, and without imposing limitations upon, the claimed invention.

Figure 1:
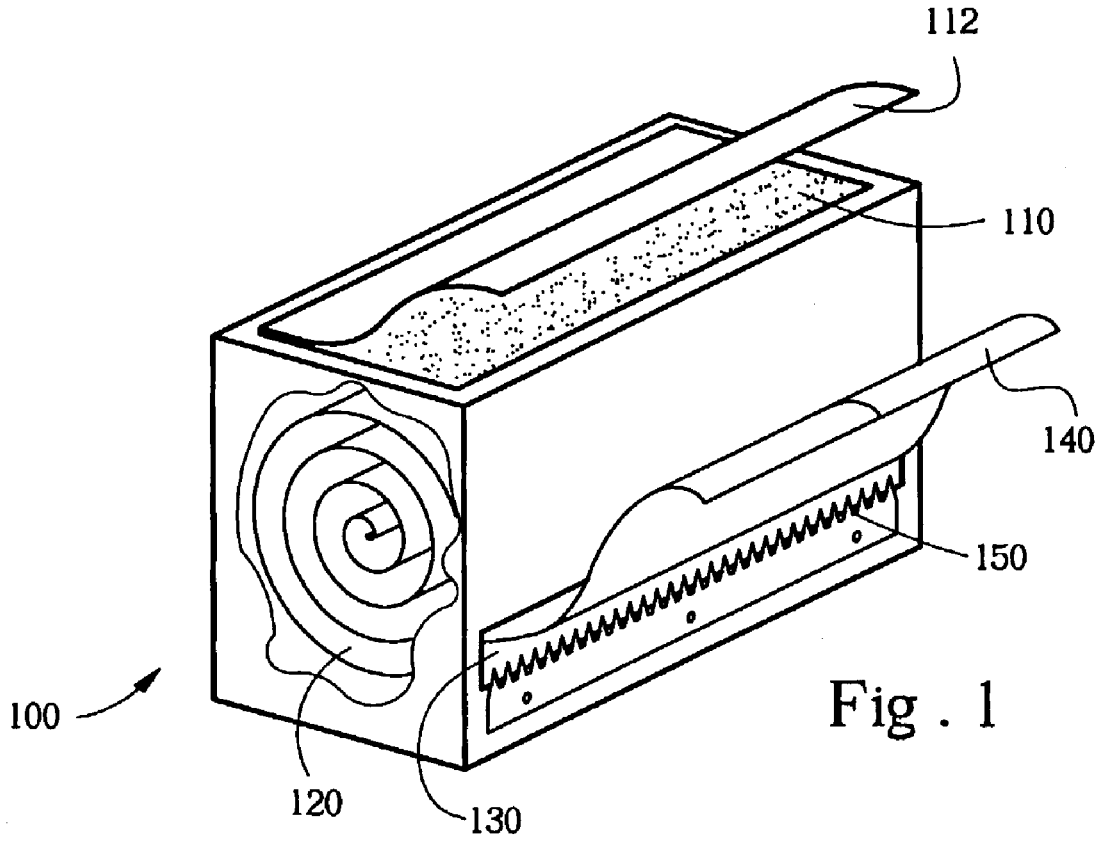
FIGS. 1–2 show exemplary embodiments of a disposal device according to the present invention.

FIG. 1 shows an embodiment of a disposal device 100. Disposal device 100 could either be square or rectangular. Disposal device is also referred to as a box casing or casing. Disposal device 100 could include an attaching means 110 to attach disposal device 100 to another device. Disposal device 100 could, for instance, be attached using attaching means 110 to a cigarette pack. Attaching means 110 is, for instance, but not limited to, a tape, glue or any other sticky material that attaches disposal device 100 to a cigarette pack. In case attaching means 110 is a sticky material, a cover sheet 112 could be included to protect the attaching means 110 from becoming less sticky. Once disposal device 100 is ready to be attached to a cigarette pack, the user of disposal device 100 will then remove cover sheet 112 and attach disposal device 100 to a surface of a cigarette pack.

Disposal device 100 could be attached to any surface of a cigarette pack (not shown) Although, disposal device 100 is not limited to a particular size or shape, it is preferred that disposal device 100 is small in size. In case disposal device 100 is attached to the bottom of a cigarette pack, then it is preferred that the attached area of disposal device 100 could be about of similar size to the receiving area at the bottom of that cigarette pack. In general, if disposal device 100 is attached to a surface of a cigarette pack, then it is preferred that the attached area of disposal device 100 could be about of similar size to the receiving area at the surface of that cigarette pack. It would also be preferred that the area of disposal device 100 and a cigarette pack that become attached are of similar size so that disposal device 100 and cigarette pack appear as one unit.

Figure 2:
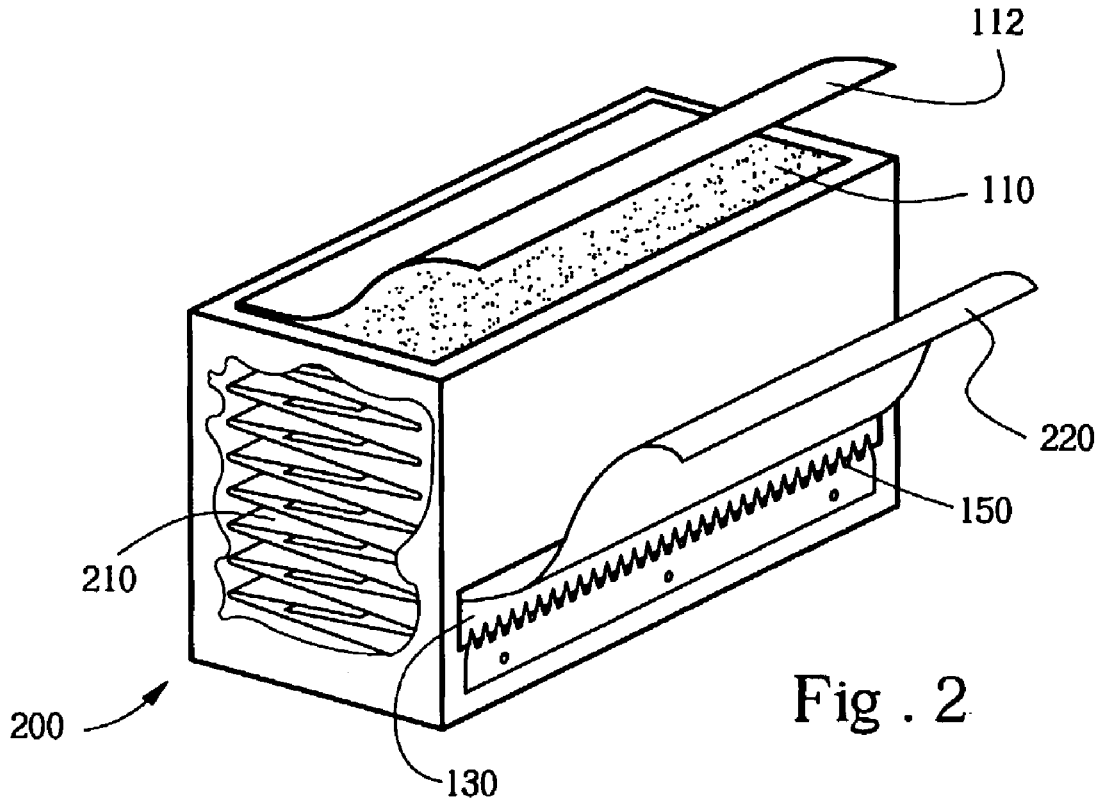

Disposal device 100 further includes heat and fire-resistant material 120 that could be stored as a roll as shown in FIG. 1. However, heat and fire-resistant material could also be stored as individual sheets 210 stacked together as shown in FIG. 2 and in a similar fashion as is common for paper towels in, for instance, a paper towel holder in a public bathroom. Heat and fire-resistant material is preferably light weight, thin, heat-resistant and fire-resistant material so that a large number of sheets can be stacked together or a large length can be rolled up. The idea is that a large number of sheets or large length of heat and fire-resistant material can be provided, to dispose the litter from the cigarettes, as it is described below.

Disposal device 100 further includes a slot 130 with a width and height large enough to allow a (part of a) sheet 140 and 220 of the heat and fire-resistant material to be pulled out, respectively shown in FIG. 1 and 2. Disposal device 100 optionally includes a tearing means 150 to tear the (part of the) sheet that was pulled out of the disposal device 100. An example of tearing means 150 is, for instance, a metal bar with multiple teeth that enables a user to tear off part of the heat and fire-resistant material. Tearing means 150 could also be a flat bar of any hard material that enables a user to tear off part of the heat and fire-resistant material.

Figure 3:
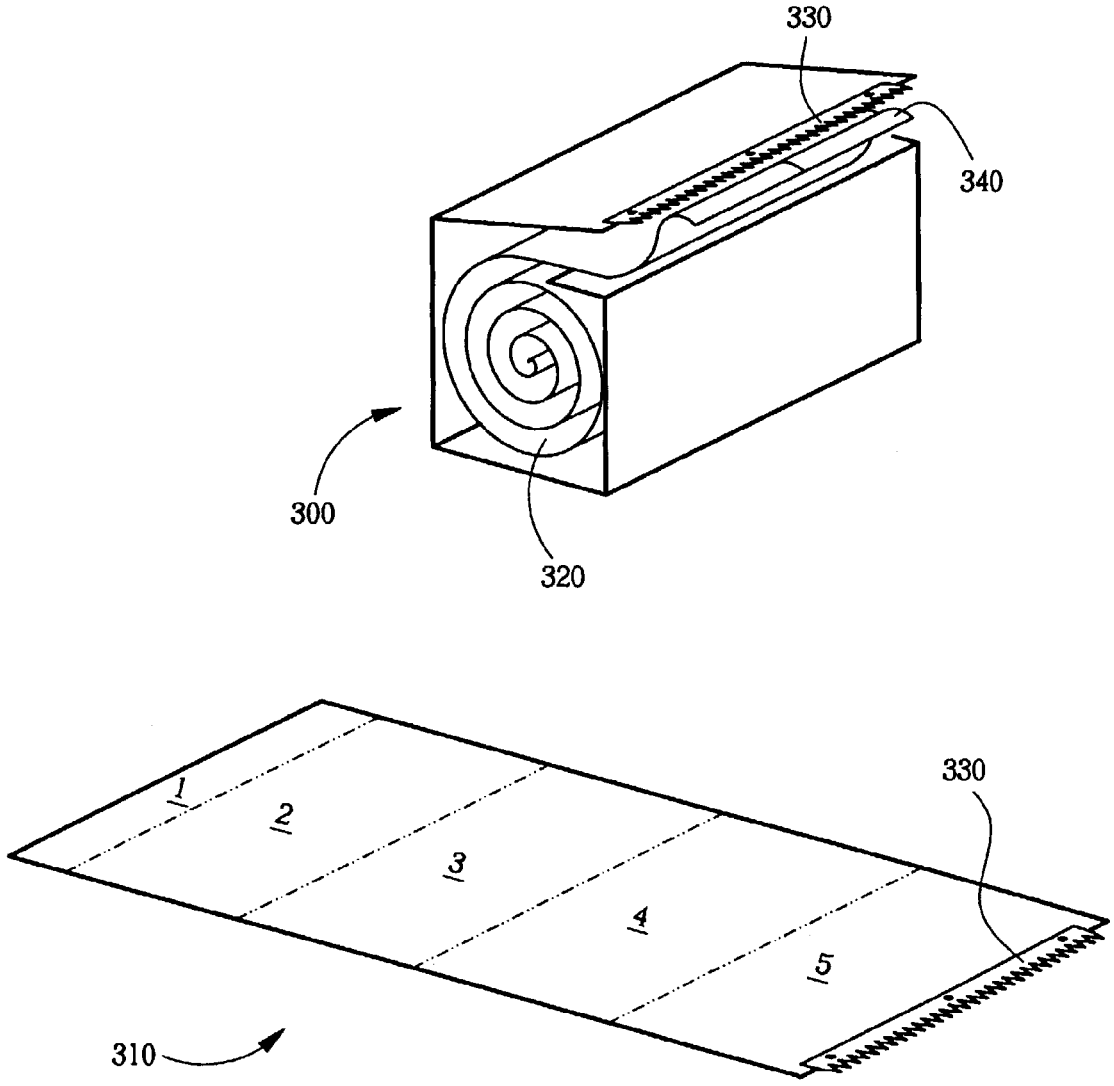
FIG. 3 shows an exemplary embodiment of a method to manufacture a disposal device according to the present invention.

FIG. 3 shows an exemplary embodiment of how disposal device 300 could be manufactured. In this particular example, a rectangular sheet of foldable material 310, such as plastic, paper, cardboard, or the like, could be used. Foldable material 310 will then be prepared to have 5 flaps 1–5 that can be folded in such a way that they create disposal device 300. Flap 1 and 5 could be attached to each other by having their respective edges, for instance, glued or taped together. Disposal device 300 also includes heat and fire-resistant material 320 which can be inserted into the folded assembly of foldable material 310. Since flap 1 and 5 are only connected by their edges and the width of heat and fire-resistant material 320 is smaller than the width of disposal device 300 minus the width of the connected edges, disposal device 300 allows heat and fire-resistant material 320 to come through the non-connected part of flap 1 and 5. Furthermore, it allows a user to pull out the heat and fire-resistant material. This way flap 1 and 5 provide a slot which serves the same purpose as slot 130 in FIGS. 1 and 2. Disposal device 300 also includes a tearing means 330 to tear (part of the) sheet 340 that was pulled out of the disposal device 300. As a person of average skill would readily appreciate, the assembly of disposal device 300 is for illustrative purposes only and the present invention is in no way limited to this particular embodiment.

Figure 4:
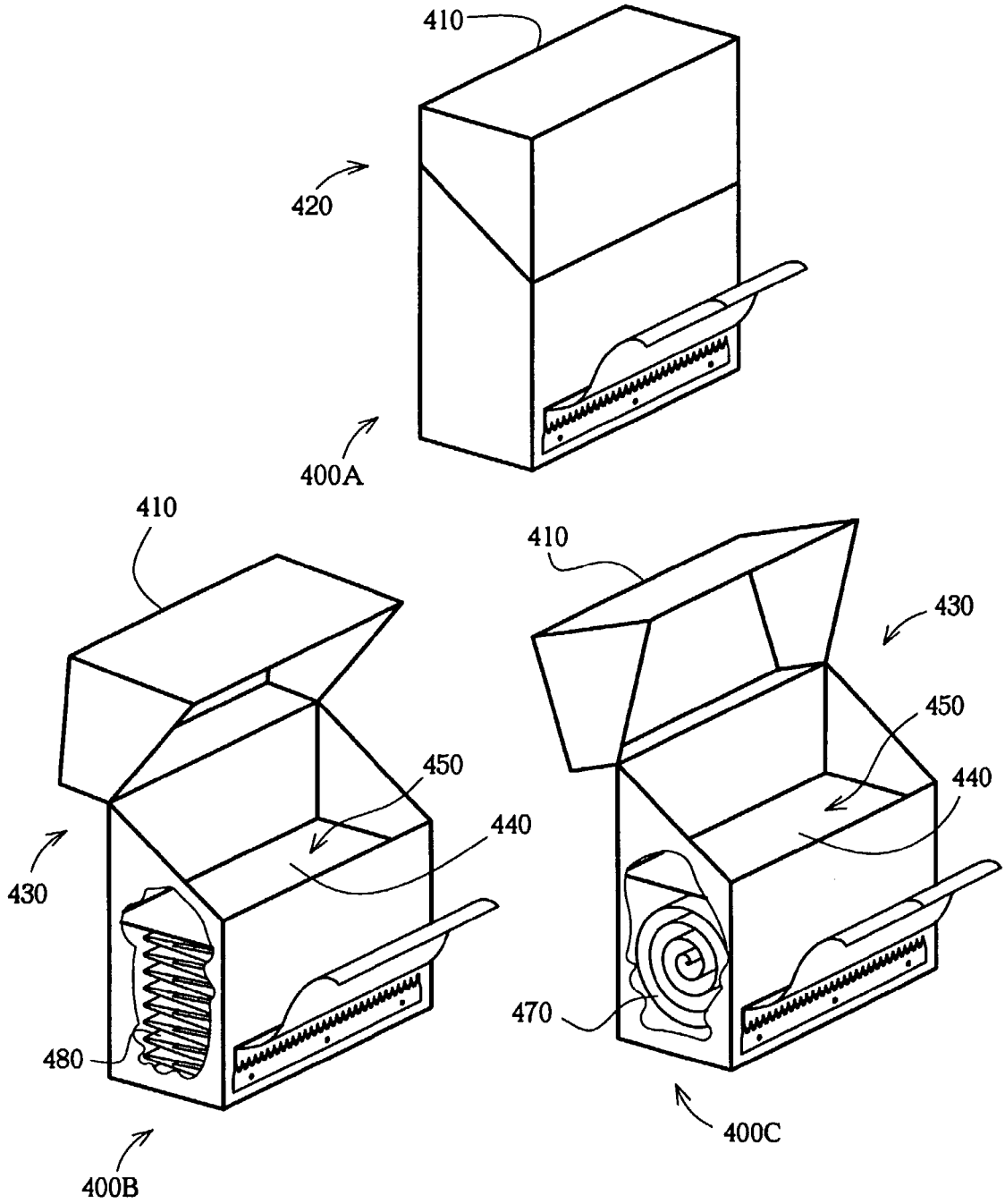
FIG. 4 shows exemplary embodiments of a disposal device with a storage means according to the present invention.

FIG. 4 shows disposal devices 400A–C which are identical to, for instance, disposal device 100 as shown in FIG. 1, with the difference that disposal devices 400A–C further include a lid 410. Lid 410 can be in a closed position 420 as in 400A or in an open position 430 in disposal device 400B and disposal device 400C respectively. The embodiments of disposal devices 400A–C in FIG. 4, include a storage area 450 that can be accessed by opening 430 and closing 420 lid 410. Storage area 450 could store any type of smoking accessories such as, but not limited to, matches, lighter, tobacco, or the like. As one of average skill in the art would readily appreciate in light of the present invention, storage area 450 is used for storing disposed material or trash as it is described below. The bottom 440 of storage area 450 separates heat and fire-resistant material 470 (in roll form) or heat and fire-resistant material 480 (in individual stacked sheets form).

Figure 5:
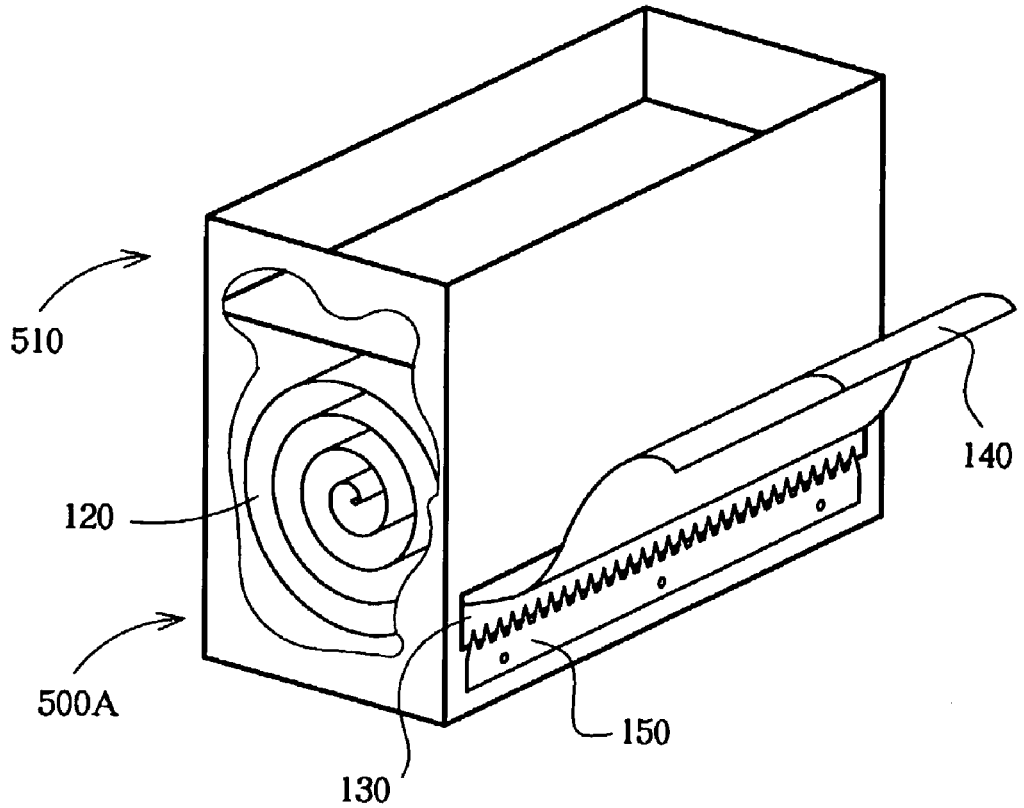
FIG. 5 shows exemplary embodiments of a disposal device with an extension that can be used to connect or combine the disposal device to another device according to the present invention.
Figure 5:
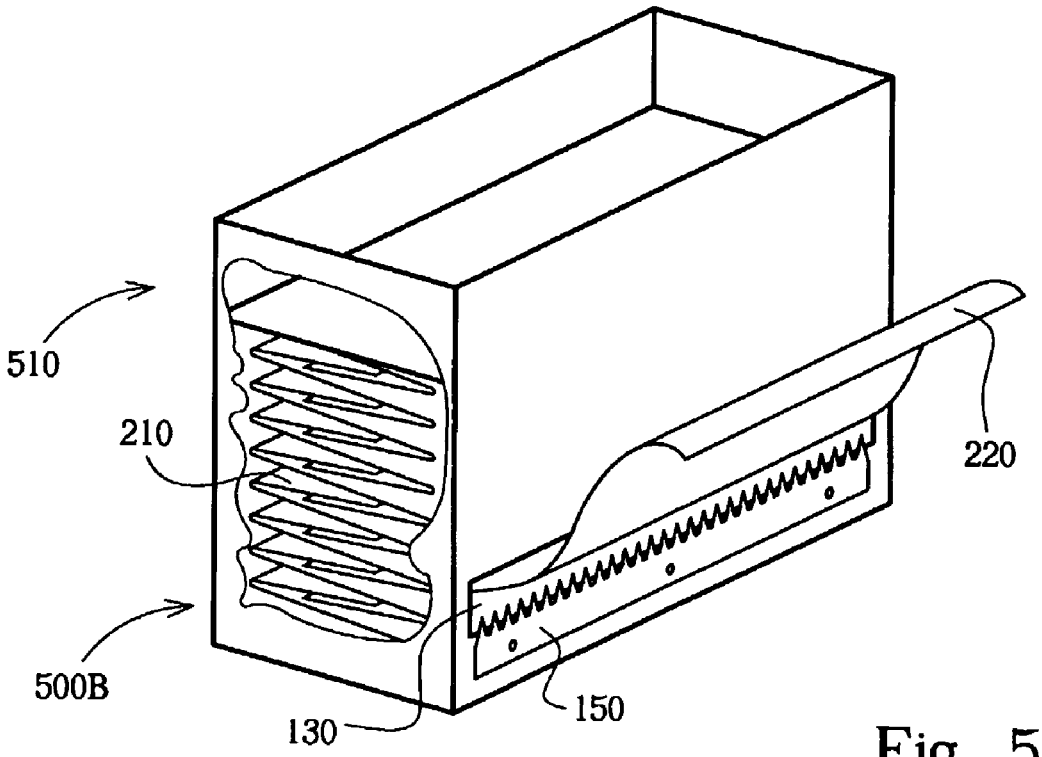

FIG. 5 shows another embodiment of how the disposal device of the present invention can be attached to another device, such as, for instance, but not limited to, a cigarette pack. FIG. 5 shows disposal devices 500A–B which are identical to, for instance, disposal device 100 and 200 as shown in FIGS. 1–2 respectively, with the difference that disposal devices 500A–B further include an extension 510. Extension 510 is an extended outer surface or an elongated wall that can be slid over another device such as a cigarette box. The connection of disposal device 500A-B to a cigarette pack is similar as a female-male connection whereby extension 510 is the female part and cigarette pack is the male part. The idea is that disposal device of the present invention fits tight enough so that it remains attached with another device, yet not too tight as it might prevent the user to attach or de-attach the disposal device with another device.

Figure 6:
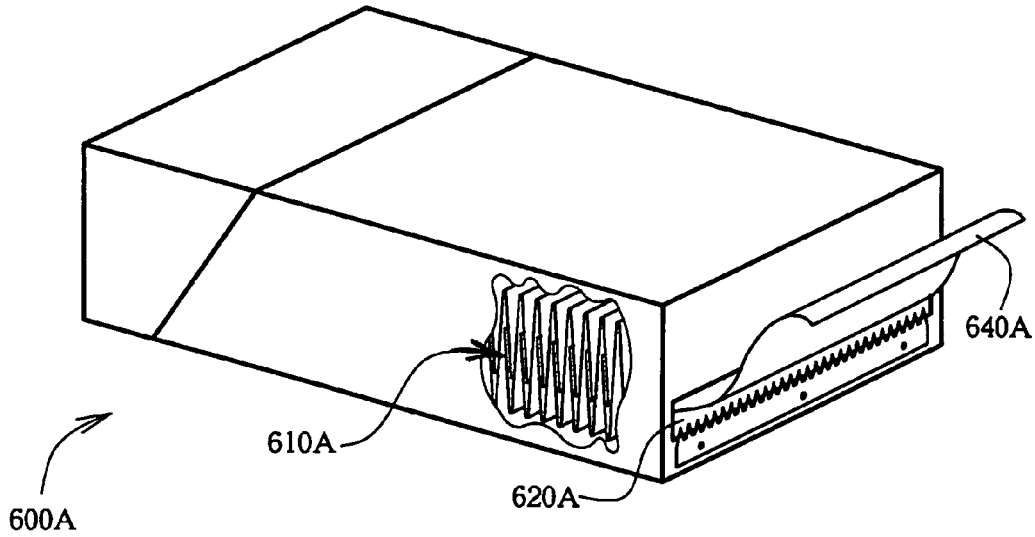
FIG. 6 shows exemplary embodiments of a disposal device inside a cigarette box according to the present invention.
Figure 6:
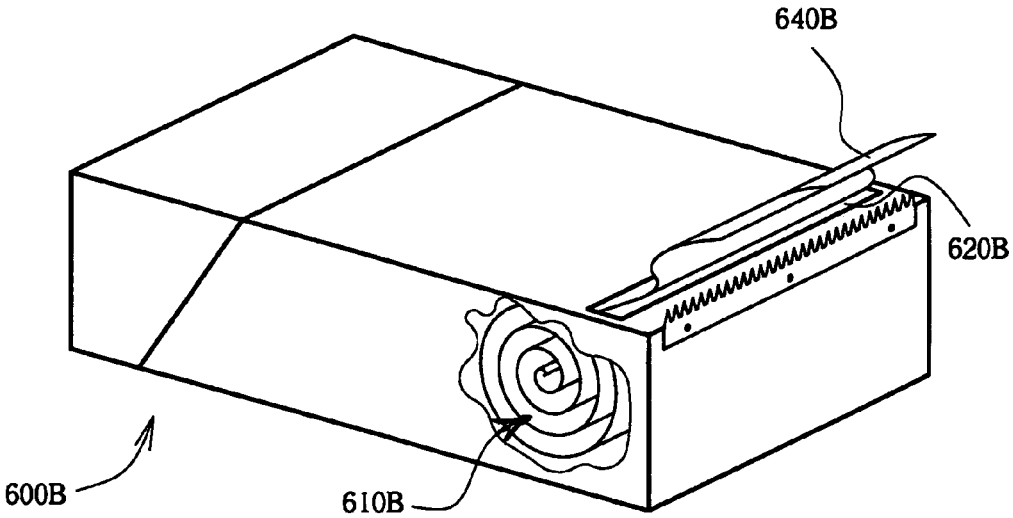

FIGS. 1–5 show examples of disposal devices that can be used as a separate disposal devices or attached to another device, such as, for instance, but not limited to, a cigarette pack by an 1 5 attaching means or an extension part. However, FIG. 6 shows embodiments of the present invention wherein disposal devices 610A–B are placed inside cigarette boxes 600A–B respectively. In FIG. 6 disposal devices 610A–B can be similar to disposal device 300 as shown in FIG. 3. In this case, the cigarette pack requires a slot 620A or 620B, similar as the slot in disposal device 300, to allow (part of a) sheet of heat and fire-resistant material 640A–B to be pulled out.

Figure 7:
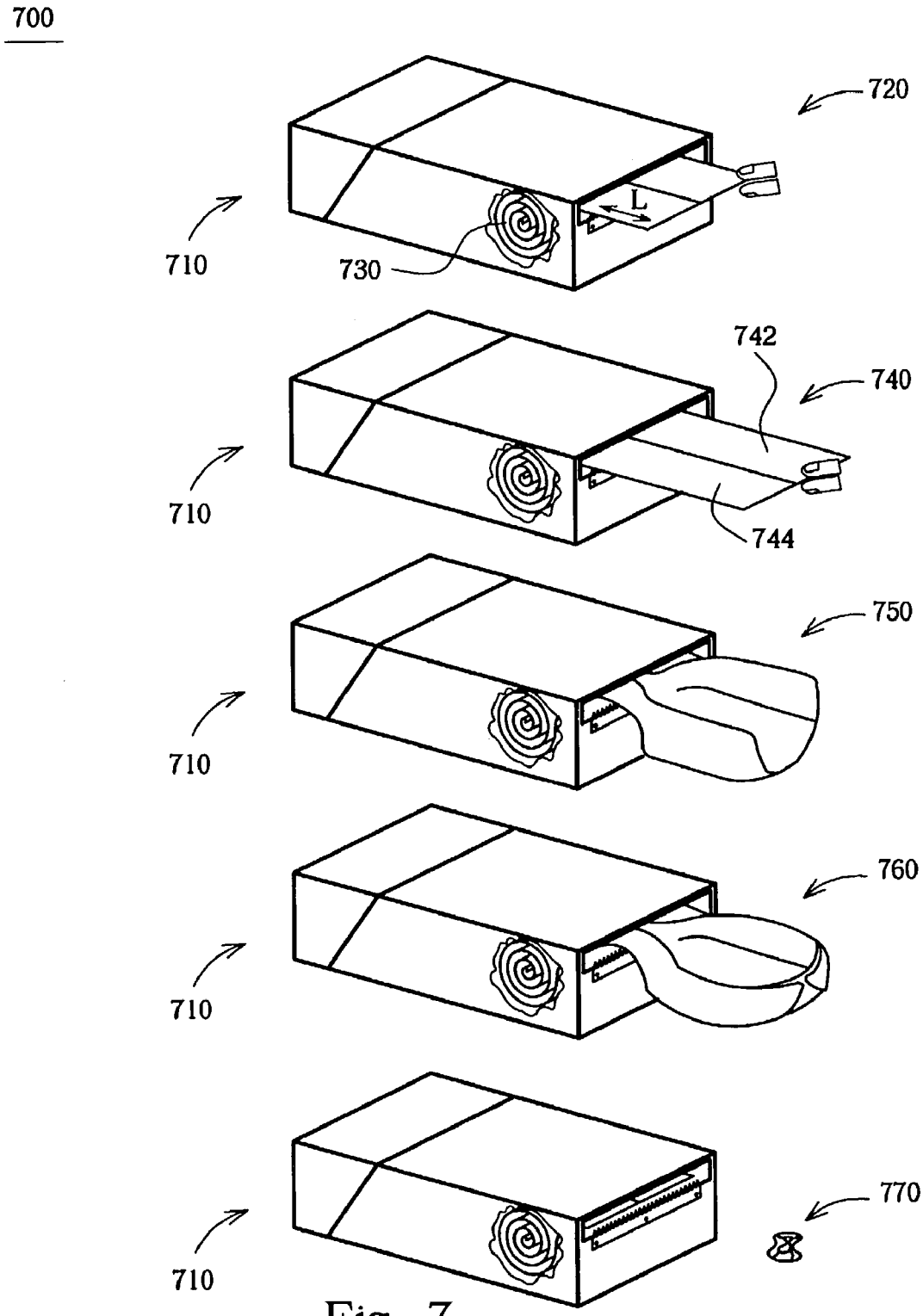
FIG. 7 shows an exemplary embodiment of the methods steps of using a disposal device according to the present invention.

FIG. 7 shows an example of the methods steps 700 of using a disposal device of the present invention. In this particular example a disposal device is included in cigarette pack 710. However, the method of the present invention is not limited to having the disposal device included in a cigarette box, attached to a surface of a cigarette box, or as a separate unit. In all these examples, the methods steps of using the disposal device of the present invention are similar. The first step is to pull 720 some part L of the heat and fire-resistant material 730 out of the disposal device. Once a sufficient part L of the heat and fire-resistant material 730 has been pulled out 740, the heat and fire-resistant material 730 can be shaped 750 to form an ashtray-like shape 760. Heat and fire-resistant material can be folded into an ashtray-like shape by folding out part 742 and part 744, however, the present invention is not limited to having part 742 and part 744. The ashtray can then be used for disposing cigarette litter and once a user is done the ashtray-like shape 760 can be folded up to a small package 770. The present invention is not limited to any size or length of the ashtray that a user creates. The size and length could accommodate space for one user using one cigarette or could accommodate several spaces for more than one user using about an equivalent number of cigarettes.

The folded package 770 with disposed material could now be stored in, for instance, disposal device 400A-C as shown in FIG. 4. Once a user of the disposal device has arrived at a public trashcan the stored package 770 can then be thrown away in the public trashcan. In case disposal device does not have such a convenient storage area as disposal device 400A-C, the disposal device could include a receptacle or a storage area to store the packaged material.

Figure 8:
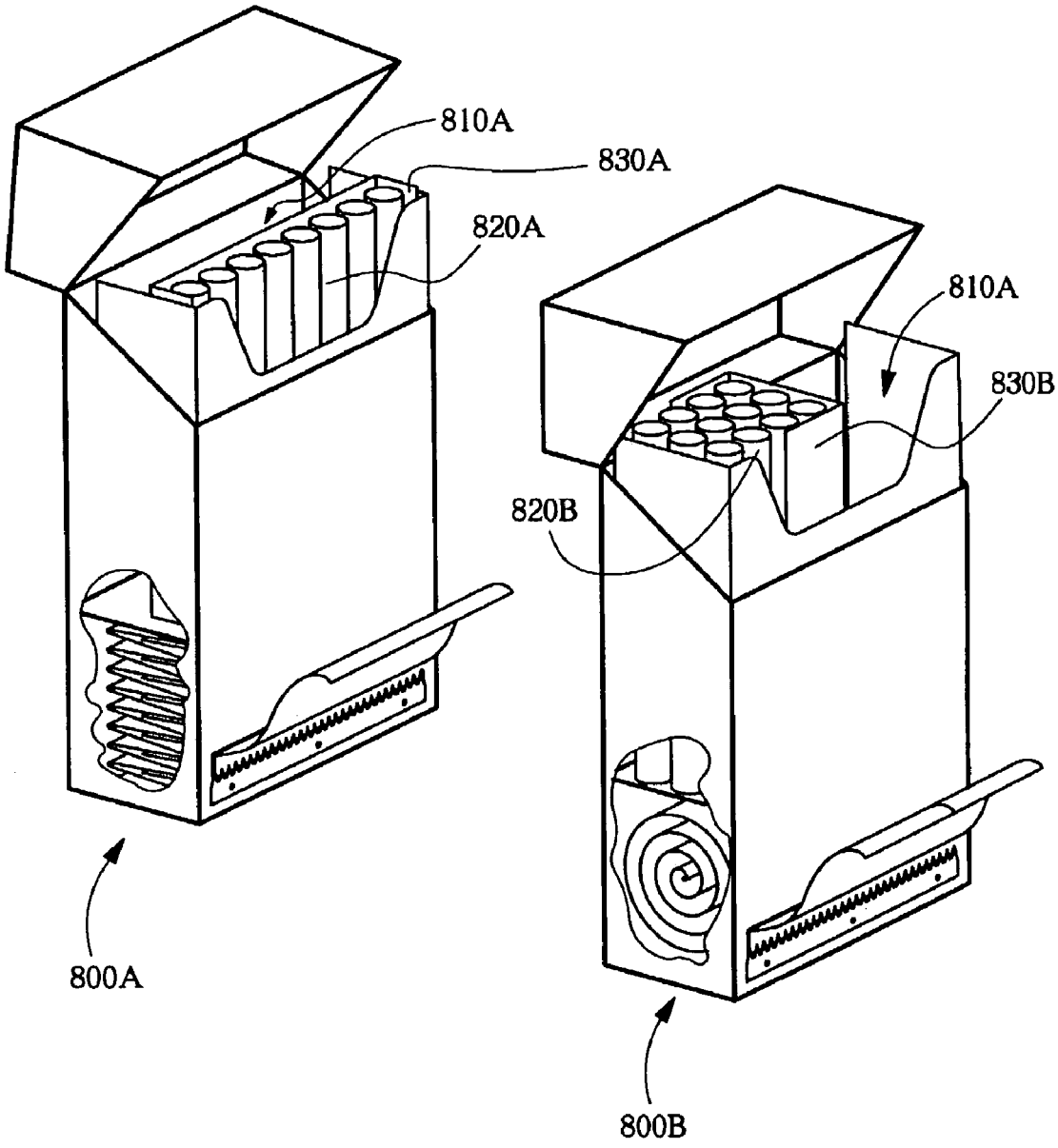
FIG. 8 shows exemplary embodiments of a storing area to store packaged material inside a cigarette pack according to the present invention.

FIG. 8 shows exemplary embodiments of storing packaged cigarette litter, such as 770, in cigarette pack 800A or 800B using area 810A or 810B, respectively. The idea is that the more cigarettes that get smoked, the larger area 810A or 810B will get to store the increasing number of packages of disposed material that could be created using the disposal device and method of the present invention. In order to keep the remaining cigarettes 820A or 820B from being damaged, a divider 830A or 830B could be placed in between the remaining cigarettes 820A or 820B and area 810A or 810B, respectively.

Figure 9:
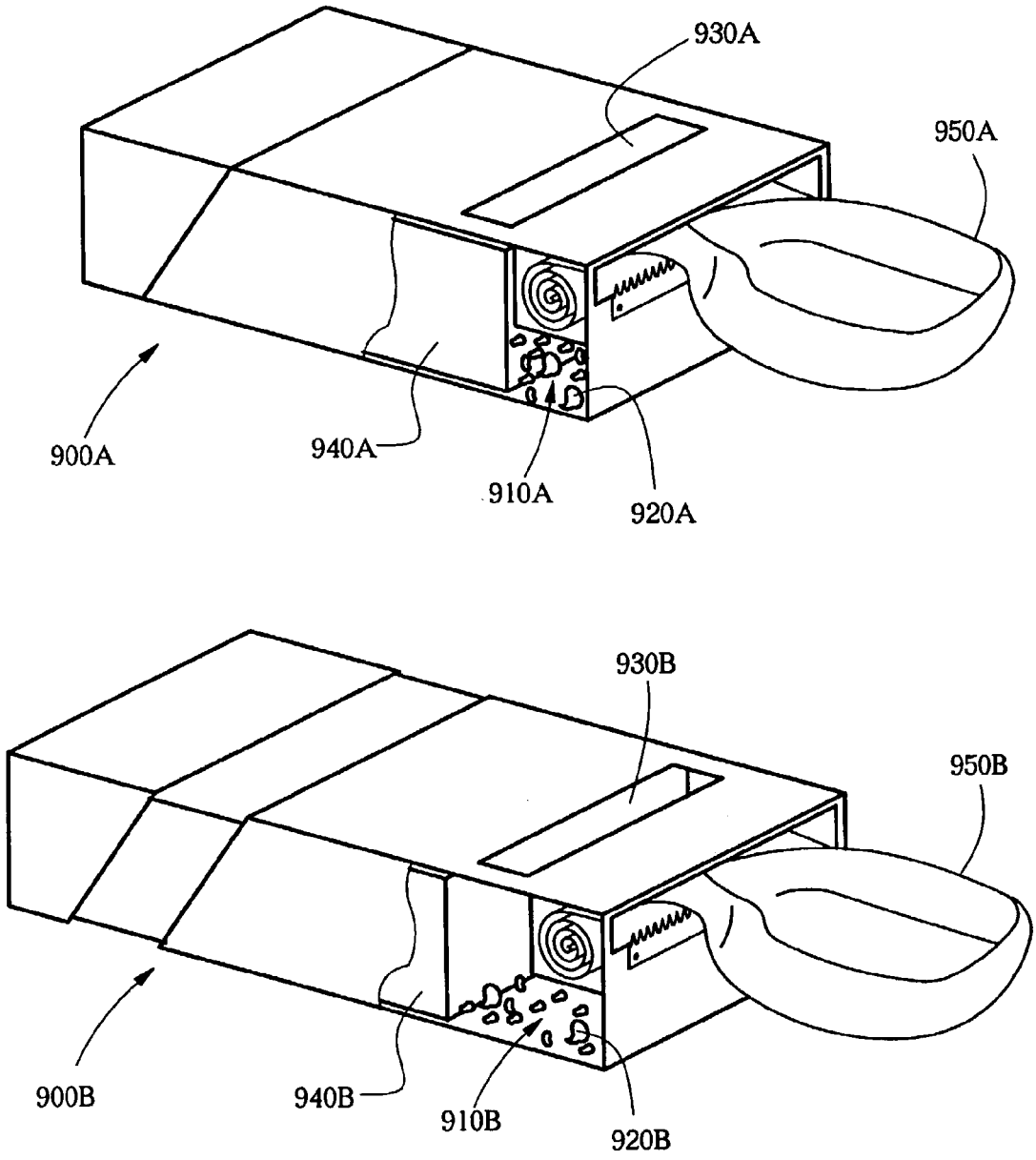
FIG. 9 shows exemplary embodiments of a storing area to store packaged material inside a cigarette pack using a receptacle area according to the present invention.

FIG. 9 shows another example of receptacle areas 910A or 910B wherein packaged material 920A or 920B can be stored and wherein receptacle area 910A or 910B are an integral part of cigarette pack 900A or 900B, respectively. Opening 930A or 930B allows one to access receptacle area 910A or 910B, which is open when the inner sleeve 940B of cigarette pack 900B is pulled out as shown in 900B. Receptacle area is closed when inner sleeve 940A is back to its stored position as is shown in 900A. FIG. 9 also shows heat and fire-resistant material shaped as an ashtray 950A or 950B which can be folded and packaged to a small package material once a user is done, after which the packaged material can be placed in the receptacle area.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed is:

1. A method for disposing cigarette litter, the method comprising:

a) integrally providing a dispensing device with a cigarette pack, the dispensing device comprising a supply of heat and fire resistant sheet material;

b) pulling out a part of the supply of heat and fire resistant sheet material from the dispensing device;

c) shaping the pulled-out part into an open receptacle;

d) utilizing the pulled-out part to collect cigarette litter; and e) reducing the pulled-out part with the cigarette litter collected therein into a small package.

2. The method of claim 1, wherein integrally providing the dispensing device with the cigarette pack comprises attaching the dispensing device to the cigarette pack by utilizing a sticky material.

3. The method of claim 1, wherein the dispensing device comprises a casing containing the supply of heat and fire resistant sheet material, and wherein integrally providing the dispensing device with the cigarette pack comprises attaching the dispensing device to the cigarette pack by placing the cigarette pack into an extension of the casing designed to receive and hold the cigarette pack.

4. The method of claim 1, further comprising placing the small package in a storage area inside the cigarette pack or the dispensing device.

5. The method of claim 1, further comprising tearing the pulled out part from the roll.

6. The method of claim 1, wherein the supply of heat and fire resistant sheet material is a continuous roll of sheet material.

7. The method of claim 1, wherein the supply of heat and fire resistant sheet material is a stack of individual sheets.

8. The method of claim 1, wherein integrally providing the dispensing device with the cigarette pack comprises integrating the dispensing device into the cigarette pack.

9. The method of claim 1, further comprising providing a tearing means on the dispensing device, and tearing the pulled out part from the supply of heat and fire resistant sheet material using the tearing means.

* * * * *